US008357246B2

(12) United States Patent
Sundaram

(10) Patent No.: US 8,357,246 B2
(45) Date of Patent: Jan. 22, 2013

(54) OBSTACLE SENSING SPRAY ARM FOR A DISHWASHING MACHINE

(75) Inventor: Sathish Andrea Sundaram, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/422,163

(22) Filed: Mar. 16, 2012

(65) Prior Publication Data

US 2012/0174950 A1 Jul. 12, 2012

Related U.S. Application Data

(62) Division of application No. 12/389,415, filed on Feb. 20, 2009, now Pat. No. 8,192,551.

(51) Int. Cl.
*B08B 9/28* (2006.01)

(52) U.S. Cl. ..... 134/25.2; 134/18; 134/57 D

(58) Field of Classification Search ..... 134/18, 134/25.2, 57 D
See application file for complete search history.

(56) References Cited

U.S. PATENT DOCUMENTS 5,330,580 A 7/1994 Whipple, III et al.
2002/0165695 A1* 11/2002 Tyson ..... 702/182

FOREIGN PATENT DOCUMENTS

DE 3732451 A1 4/1989
DE 29708598 U1 7/1997
DE 102004016270 B4 2/2006
DE 102007038673 B3 1/2009

OTHER PUBLICATIONS

German Search Report for corresponding DE102010000351, Sep. 20, 2012.

* cited by examiner

*Primary Examiner* — Michael Barr
*Assistant Examiner* — Caitlin N Dunlap
(74) *Attorney, Agent, or Firm* — Jacquelyn R. Lin; McGarry Bair PC

(57) ABSTRACT

A method of controlling the rotation of a spray arm for a dishwasher having a washing chamber, in which the spray arm is located, by rotating the spray arm with of a motor operably coupled to the spray arm.

14 Claims, 4 Drawing Sheets

OBSTACLE SENSING SPRAY ARM FOR A DISHWASHING MACHINE

CROSS-REFERENCE TO RELATED APPLICATION

This application is a divisional application of U.S. Ser. No. 12/389,415, filed Feb. 20, 2009, which is incorporated herein by reference in its entirety.

TECHNICAL FIELD

The present disclosure relates generally to a dishwashing machine and more particularly to a spray arm for a dishwashing machine.

BACKGROUND

A dishwashing machine is a domestic appliance into which dishes and other cooking and eating wares (e.g., plates, bowls, glasses, flatware, pots, pans, bowls, et cetera) are placed to be washed. A dishwashing machine includes at least one spray arm that sprays water over the wares to clean such wares.

SUMMARY

A method of controlling the rotation of a spray arm for a dishwasher having a washing chamber, in which the spray arm is located, by rotating the spray arm by actuation of a motor operably coupled to the spray arm; determining whether the load on the spray arm exceeds a predetermined limit by comparing current drawn by the motor to a predetermined limit; generating a control signal when the current exceeds the predetermined limit, and reversing the rotation of the spray arm in response to the generation of the control signal.

BRIEF DESCRIPTION OF THE DRAWINGS

The detailed description particularly refers to the following figures, in which.

DETAILED DESCRIPTION OF THE DRAWINGS

Figure 1:
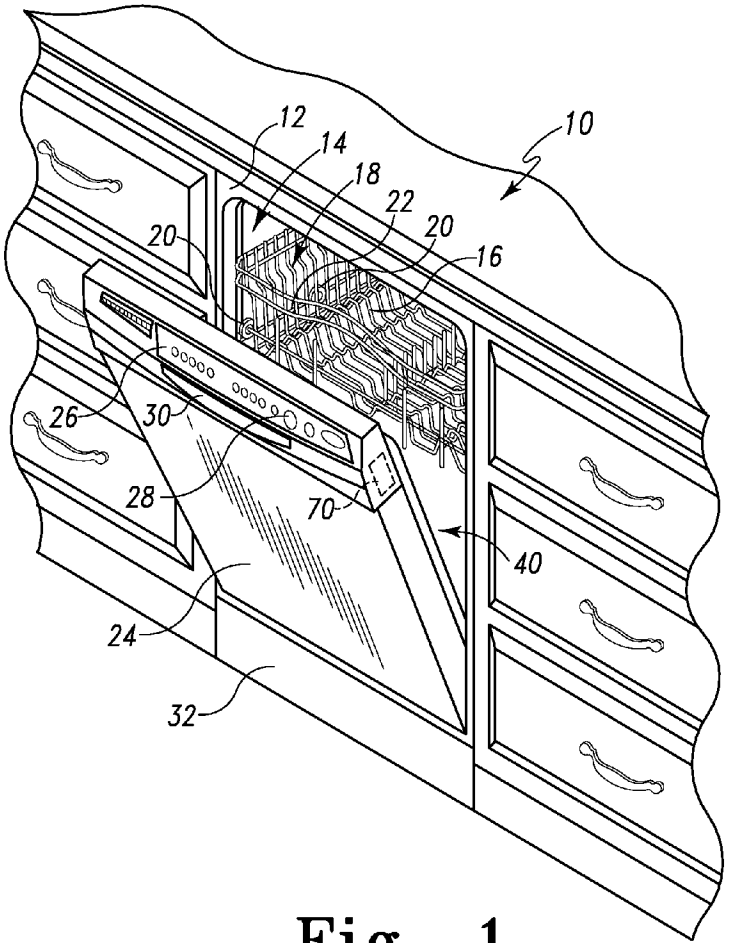
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used to control the operation of the dishwasher 10. A handle 30 is also included in the control panel 26. The user may use the handle 30 to unlatch the door 24 such that the door 24 may be opened.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. The machine compartment 32 houses components such as the dishwasher's fluid pump(s) and valve(s), along with the associated wiring and plumbing.

Figure 2:
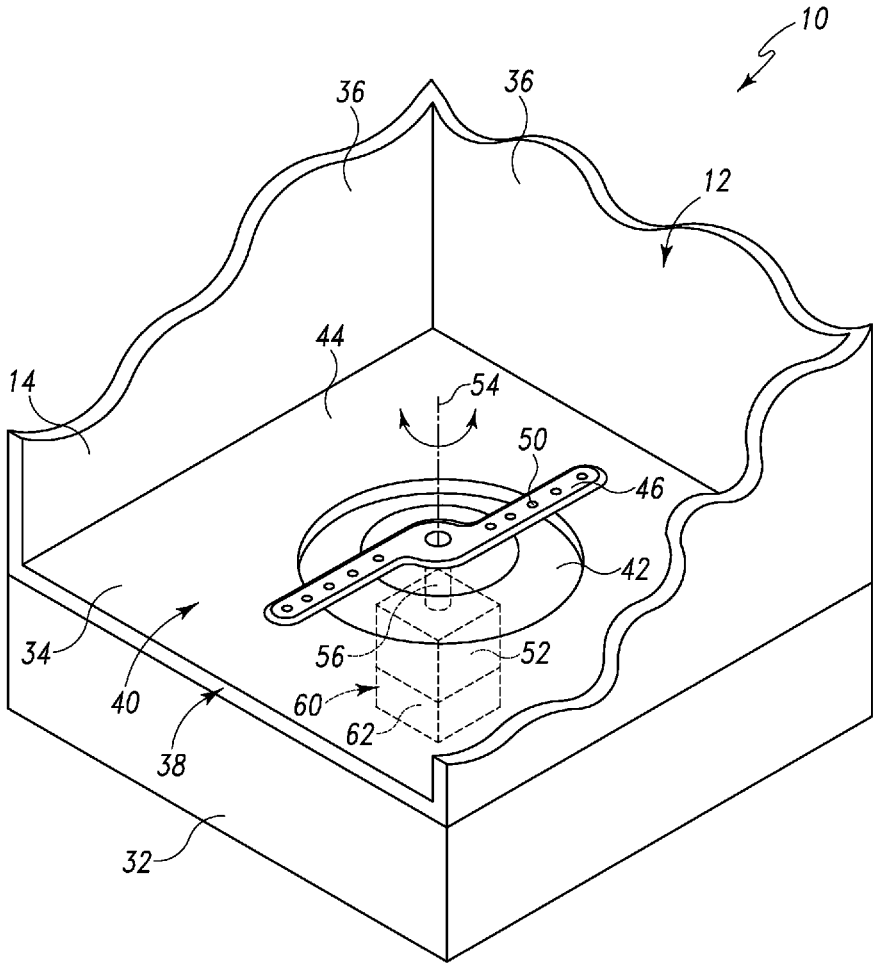
FIG. 2 is a fragmentary perspective view of the tub of the dishwashing machine of FIG. 1.

Referring now to FIG. 2, the tub 12 of the dishwasher 10 is shown in greater detail. The tub 12 includes a number of side walls 36 extending upwardly from a bottom wall 34 to define the washing chamber 14. The open front side 38 of the tub 12 defines an access opening 40 of the dishwasher 10. The access opening 40 provides the user with access to the dish racks 16 positioned in the washing chamber 14 when the door 24 is open. When closed, the door 24 seals the access opening 40, which prevents the user from accessing the dish racks 16. The door 24 also prevents fluid from escaping through the access opening 40 of the dishwasher 10 during a wash cycle.

Figure 3:
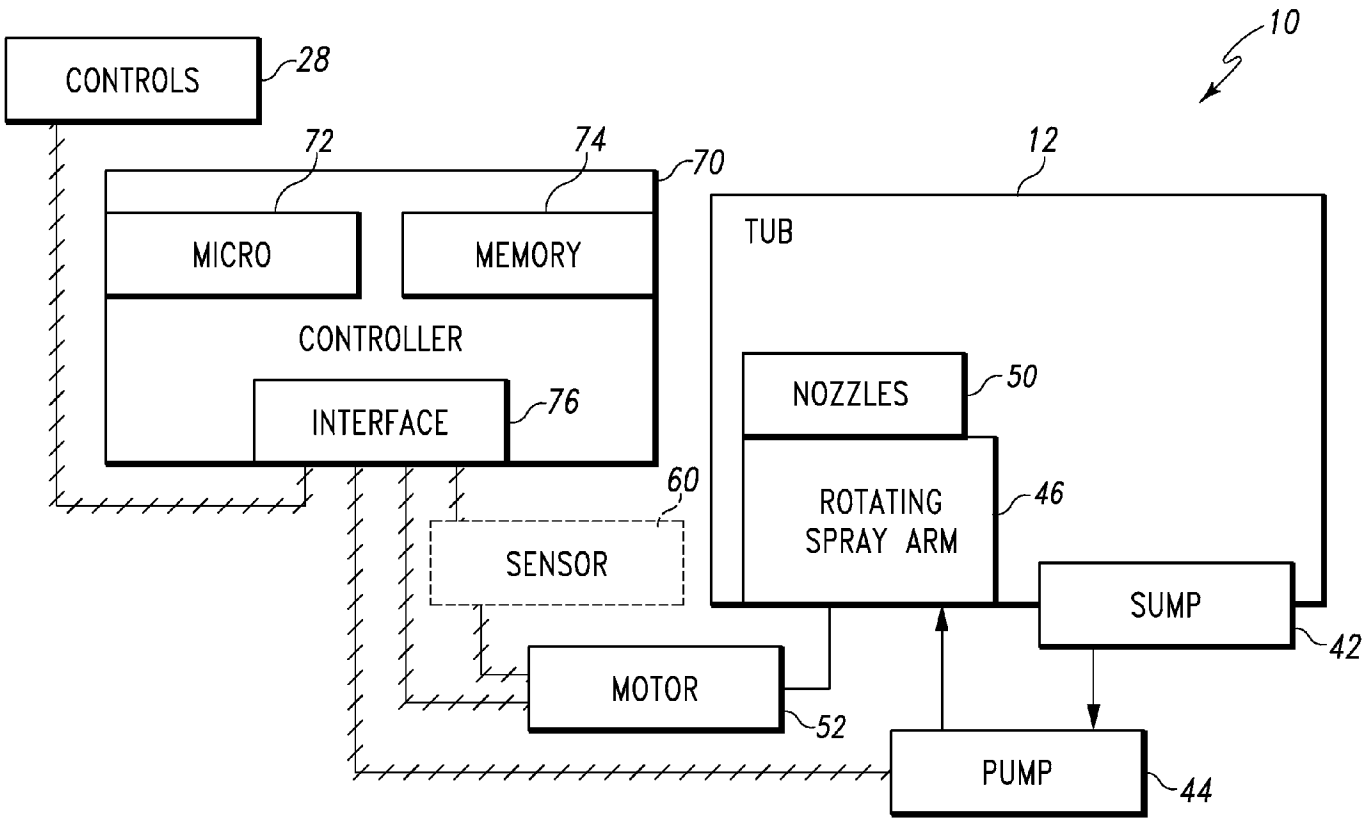
FIG. 3 is a simplified flow diagram of a method of operating a dishwashing machine.

The bottom wall 34 of the tub 12 has a recirculation sump 42 formed therein. The recirculation sump 42 is formed (e.g., stamped or molded) into the bottom wall 34 of the tub 12. In particular, as shown in FIG. 2, the recirculation sump 42 defines a reservoir that extends downwardly in a direction away from an upper surface 44 of the bottom wall 34 of the tub 12. The sloped configuration of the bottom wall 34 directs fluid, such as water and/or wash chemistry (i.e., water and/or detergents, enzymes, surfactants, and other cleaning or conditioning chemistry), into the recirculation sump 42 during a wash cycle. Such water and/or wash chemistry is drained from the recirculation sump 42 and re-circulated onto the dish racks 16 by a pump 44 (see FIG. 3) located in the mechanical compartment 32. The pump 44 is connected to a rotating spray arm 46 that sprays water and/or wash chemistry onto the dish racks 16 (and hence any wares positioned thereon).

As shown in FIG. 2, the spray arm 46 has a number of nozzles 50. Fluid passes from the pump into the spray arm 46 and then exits the spray arm 46 through the nozzles 50. In the illustrative embodiment described herein, the nozzles 50 are embodied simply as holes formed in the spray arm 46. However, it is within the scope of the disclosure for the nozzles 50 to include inserts such as tips or other similar structures that are placed into the holes formed in the spray arm 46. Such inserts may be useful in configuring the spray direction or spray pattern of the fluid expelled from the spray arm 46.

An electric drive motor 52 is located in the machine compartment 32. The motor 52 rotates the spray arm 46 about an imaginary axis 54 extending upwardly from the bottom wall 34 of the tub 12. In the illustrative embodiment shown in FIG. 2, the spray arm 46 is secured to the motor 52 via a shaft 56. It should be appreciated that in other embodiments the dishwasher 10 may include belts, pulleys, gearing, etc. that connect the motor 52 to the spray arm 46. The motor 52 is connected to a power supply (not shown), which provides the electric current necessary for the motor 52 to spin the shaft 56 and rotate the spray arm 46. As discussed in more detail below, the motor 52 is operable to reverse the rotation of the spray arm 46 when the spray arm 46 encounters an obstacle that obstructs or halts its rotation. Such an obstacle may be a dish, glass, or other ware knocked from the dish rack 16 into the path of the rotating spray arm 46.

A sensor 60 monitors the rotation of the spray arm 46. In the illustrative embodiment, the sensor 60 is operable to measure the amount of external loading experienced by the motor 52. As shown in FIG. 2, the sensor 60 is embodied as a torque sensor 62 coupled to the motor 52. The amount of torque measured by the torque sensor 62 is indicative of the amount external loading on the motor 52. In other embodiments, the sensor 60 may be a motor speed sensor or an electrical circuit operable to measure the amount of external loading on spray arm 46 or motor 52. For example, the sensor 60 may be a circuit that measures the electric current drawn from the power supply when the motor 52 is rotating the spray arm 46. Such a measurement would be indicative of the external loading experienced by the motor 52.

The dishwasher 10 also includes an electronic control unit (ECU) or "electronic controller" 70. The electronic controller 70 may be positioned in either the door 24 or the machine compartment 32 of the dishwasher 10. The electronic controller 70 is, in essence, the master computer responsible for interpreting electrical signals sent by sensors associated with the dishwasher 10 and for activating electronically controlled components associated with the dishwasher 10. For example, the electronic controller 70 is configured to control operation of the pump 44, and the motor 52 (and hence the spray arm 46). The electronic controller 70 is also configured to monitor various signals from the controls 28 and the sensor 60 and to determine when various operations of the dishwasher 10 should be performed, amongst many other things. In particular, as will be described in more detail below with reference to FIG. 4, the electronic controller 70 is operable to control the components of the dishwasher 10 such that the direction of rotation of the spray arm 46 is reversed when the spray arm 46 encounters an obstacle while it is rotating.

To do so, the electronic controller 70 includes a number of electronic components commonly associated with electronic units utilized in the control of electromechanical systems. For example, the electronic controller 70 may include, amongst other components customarily included in such devices, a processor such as a microprocessor 72 and a memory device 74 such as a programmable read-only memory device ("PROM") including erasable PROM's (EPROM's or EEPROM's). The memory device 74 is provided to store, amongst other things, instructions in the form of, for example, a software routine (or routines) which, when executed by the microprocessor 72, allows the electronic controller 70 to control operation of the dishwasher 10.

The electronic controller 70 also includes an analog interface circuit 76. The analog interface circuit 76 converts the output signals from various sensors (e.g., the sensor 60) into a signal which is suitable for presentation to an input of the microprocessor 72. In particular, the analog interface circuit 76, by use of an analog-to-digital (A/D) converter (not shown) or the like, converts the analog signals generated by the sensors into a digital signal for use by the microprocessor 72. It should be appreciated that the A/D converter may be embodied as a discrete device or number of devices, or may be integrated into the microprocessor 72. It should also be appreciated that if any one or more of the sensors associated with the dishwasher 10 generate a digital output signal, the analog interface circuit 76 may be bypassed.

Similarly, the analog interface circuit 76 converts signals from the microprocessor 72 into an output signal which is suitable for presentation to the electrically-controlled components associated with the dishwasher 10 (e.g., the motor 52). In particular, the analog interface circuit 76, by use of a digital-to-analog (D/A) converter (not shown) or the like, converts the digital signals generated by the microprocessor 72 into analog signals for use by the electronically-controlled components associated with the dishwasher 10. It should be appreciated that, similar to the A/D converter described above, the D/A converter may be embodied as a discrete device or number of devices, or may be integrated into the microprocessor 72. It should also be appreciated that if any one or more of the electronically-controlled components associated with the dishwasher 10 operate on a digital input signal, the analog interface circuit 76 may be bypassed.

Hence, the electronic controller 70 may be operated to control operation of the motor 52 and therefore the rotation of the spray arm 46. In particular, the electronic controller 70 executes a routine including, amongst other things, a control scheme in which the electronic controller 70 monitors outputs of the sensors associated with the dishwasher 10 to control the inputs to the electronically-controlled components associated therewith. To do so, the electronic controller 70 communicates with the sensors associated with the dishwasher 10 to determine, amongst numerous other things, the state of the door 24 and whether the spray arm 46 is rotating as commanded. Armed with this data, the electronic controller 70 performs numerous calculations each second, including looking up values in preprogrammed tables, in order to execute algorithms to perform such functions as controlling the direction of rotation of the motor 52, controlling to the pump 44 to move fluid through the spray arm 46, out the nozzles 50, and onto the wares in the dishwasher 10, and so forth.

As will be appreciated by those of the skill in the art, the dishwasher 10 may include elements other than those shown and described above, such as, by way of example, an electric heating element to assist in drying the wares or a filter to remove particulates from the re-circulated wash chemistry or rinse chemistry. It should also be appreciated that the location of many components (i.e., in the washing chamber 14, in the machine compartment 32, in or on the door 24, etc.) may also be altered.

In operation, the spray arm 46 sprays fluid, which may be water and/or wash chemistry, onto the wares positioned on the dish racks 16. The pump 44 draws the fluid from the recirculation sump 42 (or a water supply line) and passes the fluid into the spray arm 46. The fluid then exits the spray arm 46 through the nozzles 50 as a spray directed at the dish racks 16 (and hence any wares positioned thereon).

The motor 52 rotates the spray arm 46 as commanded by the electronic controller 70 to ensure coverage of the entire tub 12. As the motor 52 rotates the spray arm 46, the sensor 60 measures the external load on the spray arm 46. If the sensor 60 measures a high load on the spray arm 46, such as, for example, when the spray arm 46 encounters an obstacle that obstructs or halts its rotation, the motor 52 reverses the rotation of the spray arm 46.

Figure 4:
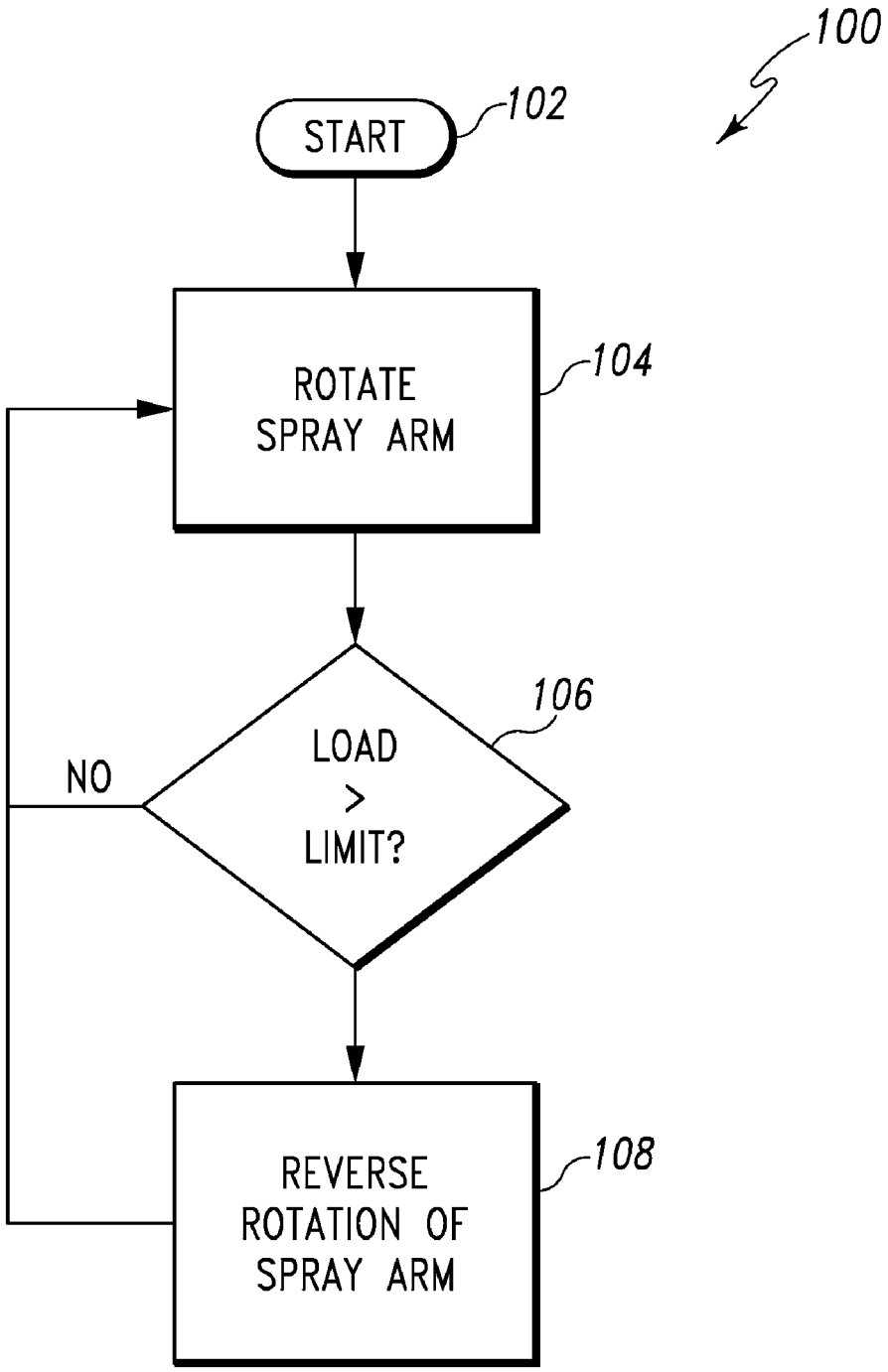
FIG. 4 is a flow chart illustrating a control algorithm for the dishwashing machine.

Referring to FIG. 4, an algorithm 100 for controlling the rotation of the spray arm 46 is illustrated. The method 100 includes process step 102 in which the signal is given to start rotating the wash arm 46. The electronic controller 70 may generate the start signal in response to the user accessing the controls 28 on the control panel 26. Additionally, or alternatively, the signal to start rotating the spray arm 46 may be generated at a pre-programmed time or after a delay period set by the user.

In process step 104, the electronic controller 70 executes a control scheme to command the motor 52 to begin to rotate the spray arm 46. While rotating, the spray arm 46 sprays fluid through the nozzles 50 onto the wares positioned on the dish racks 16. The sensor 60 measures the amount of load on the spray arm 46 while the spray arm 46 is rotating. The measurement taken by the sensor 60 may be, for example, the amount of motor torque, the amount of electric current drawn by the motor, or the motor speed.

In process step 106, the electronic controller 70 compares the measurement taken by the sensor 60 to a predetermined limit stored in the memory 74. The predetermined limit is a value indicative of when the spray arm 46 is no longer rotating normally. That is, the predetermined limit is set such that when the spray arm 46 is rotating normally, the load measured by the sensor 60 is less than the predetermined limit. The load measured by the sensor 60 is greater than the predetermined limit when the spray arm 46 encounters an obstacle that prevents it from rotating.

The spray arm 46 continues to rotate in the same direction during a wash cycle so long as the measured load is less than the predetermined limit, but whenever the measured load exceeds the predetermined limit, the electronic controller 70 will command the motor 52 to reverse the direction of rotation of the spray arm 46. In process step 108, the electronic controller 70 generates a control signal to reverse the rotation of the spray arm 46 when the measured load exceeds the predetermined limit. The motor 52 responds to the control signal by reversing the rotation of the spray arm 46. The spray arm 46 will continue to rotate in this direction until the measured load again exceeds the predetermined limit, at which point the electronic controller 70 will again command the motor 52 to reverse the direction of rotation of the spray arm 46. The motor 52 will receive the control signal from the electronic controller 70 and reverse the direction of rotation in response thereto. In this way, the spray arm 46 may oscillate back and forth to spray fluid throughout the tub 12 despite the presence of an obstacle in the path of rotation.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A method of controlling the rotation of a spray arm for a dishwasher having a washing chamber in which the spray arm is located, the method comprising:

rotating the spray arm by actuation of a motor operably coupled to the spray arm;

determining whether the load on the spray arm exceeds a predetermined limit by comparing current drawn by the motor to a predetermined limit;

generating a control signal when the current exceeds the predetermined limit, and reversing the rotation of the spray arm in response to the generation of the control signal.

2. The method of claim 1 wherein the determining comprises an electronic controller comparing the value of a signal generated by a sensor, with the signal being indicative of the current drawn by the motor, to the predetermined limit.

3. The method of claim 2, wherein the rotating comprises actuating a reversible motor in a first direction to rotate the spray arm in response to a start command signal.

4. The method of claim 3, wherein the reversing comprises reversing the rotation of the motor such that the spray arm reverses its rotation.

5. The method of claim 1, wherein the rotating comprises measuring the amount of electric current drawn by a motor by using a circuit of an electronic controller coupled to the motor.

6. The method of claim 5, wherein the generating a control signal comprises the electronic circuit generating a signal corresponding to the measured amount of electric current.

7. The method of claim 6, wherein the determining comprises the electronic controller comparing the value of the signal corresponding to the amount of electric current drawn by the motor to the predetermined limit.

8. The method of claim 1 further comprising recirculating liquid in the washing chamber during the rotating of the spray arm.

9. The method of claim 8 wherein the recirculating liquid comprises pumping liquid from the washing chamber to the spray arm.

10. The method of claim 8 wherein the recirculating liquid comprises spraying liquid from at least one nozzle in the spray arm.

11. The method of claim 10 wherein the spraying liquid from at least one nozzle comprises spraying liquid from multiple nozzles.

12. The method of claim 1 wherein the predetermined limit corresponds to the load on the spray arm required to prevent the spray arm from rotating.

13. The method of claim 1 further comprising determining the current drawn by the motor.

14. The method of claim 13 wherein the determining the current drawn by the motor comprises the current supplied by a power supply to the motor.

* * * * *